US007326885B2

(12) United States Patent
Lockwood et al.

(10) Patent No.: US 7,326,885 B2
(45) Date of Patent: Feb. 5, 2008

(54) HOT PLATE WITH STAINLESS STEEL TOP

(75) Inventors: Mark D. Lockwood, Dubuque, IA (US); Peter Riniker, Platteville, WI (US); James R. Edwards, Dubuque, IA (US)

(73) Assignee: Barnstead/Thermolyne Corporation, Dubuque, IA (US)

( * ) Notice: Subject to any disclaimer, the term of this patent is extended or adjusted under 35 U.S.C. 154(b) by 93 days.

(21) Appl. No.: 11/381,228

(22) Filed: May 2, 2006

(65) Prior Publication Data

US 2007/0257021 A1 Nov. 8, 2007

(51) Int. Cl.
*H05B 3/68* (2006.01)
*H05B 3/06* (2006.01)

(52) U.S. Cl. ..... 219/443.1; 219/448.17; 219/448.1; 219/468.2; 219/448.11; 219/448.19; 219/462.1; 219/464.1; 219/465.1; 219/553; 219/540; 219/541; 219/530

(58) Field of Classification Search ..... 219/443.1, 219/448.17, 553, 448.1, 468.1, 540–1, 530, 219/512, 468.2, 448.11, 448.19, 432–3, 462.1, 219/464.1, 465.1
See application file for complete search history.

(56) References Cited

U.S. PATENT DOCUMENTS 4,045,654 A 8/1977 Eide
4,153,833 A 5/1979 Fischer et al.
4,270,674 A 6/1981 Moore
4,348,581 A 9/1982 Fischer et al.
4,384,192 A 5/1983 Lowell et al.
4,431,908 A 2/1984 Fischer et al.
4,467,181 A 8/1984 Fischer et al.
4,481,407 A 11/1984 Stokes et al.
4,605,841 A 8/1986 Fischer et al.
4,680,452 A 7/1987 Fischer et al.
4,697,068 A 9/1987 Schreder
4,962,297 A 10/1990 Lowenberg
5,834,739 A 11/1998 Lockwood et al.

*Primary Examiner*—Shawntina Fuqua
(74) *Attorney, Agent, or Firm*—Wood, Herron & Evans, L.L.P.

(57) ABSTRACT

A hotplate with a stainless steel top plate to support a vessel. The stainless steel top plate has an upper surface with a substantially centrally located depression having a depth and area generally sufficient to absorb upward crowning of the top plate when heated. A heating unit is in a heat transfer relation with the stainless steel top plate, and a base unit is connected to the heating plate assembly; however, the base unit is not fastened directly to the stainless steel top plate, so that the stainless steel top plate can expand more uniformly when heated.

20 Claims, 2 Drawing Sheets

HOT PLATE WITH STAINLESS STEEL TOP

FIELD OF THE INVENTION

This invention relates generally to hot plates and more particularly, to heating surfaces for a hot plate to heat substances in a vessel or container placed on the hot plate.

BACKGROUND OF THE INVENTION

Hot plates are devices that provide a heated horizontal surface and are widely used in a variety of industrial and laboratory settings for heating substances contained in vessels. For instance, hot plates are commonly used for heating chemicals and other materials in open or closed vessels, in order to promote a chemical reaction or change in properties of the materials. A typical hot plate includes a heating element disposed below or embedded within a horizontal support surface for the vessel to be heated. A housing or base unit is usually provided for containing the electrical leads and connections between the heating element and an electrical supply line, as well as other components such as switches, over-temperature shut-off devices, potentiometer controls, and the like.

In many industrial and laboratory processes, there is frequently a need for the material in the vessel to experience motion or circulation simultaneously with it being heated. Thus, various types of stirring hot plates have been developed. One known type of stirring hot plate employs a magnetic stirring device which has a driving magnet mounted on the motor shaft directly below the support surface of the hot plate. The driving magnet produces a magnetic field that couples with a magnetic stirring bar placed in the material being heated, thereby causing the stirring bar to rotate in synchronism with the permanent magnet. By changing the speed and direction of rotation of the rotating drive magnet, the magnetically coupled stirring bar is effective to impart different types of stirring actions inside the vessel.

It is known to make hot plate tops from various materials, for example, copper iron, glass, aluminum and stainless steel; but all of those materials have disadvantages. For example, glass is breakable; and copper, iron and aluminum are subject to corrosion and/or oxidation from exposure to chemicals that may be present in the laboratory. Corrosion may be reduced by coating those materials, but such coatings are expensive and may not be commercially practical for less expensive hot plates.

Stainless steel has an advantage of being resistant to corrosion, but it has a disadvantage of being a relatively poor thermal conductor. Further, often a stainless steel top is connected to a base housing or unit at numerous points generally near a perimeter of the stainless steel top by a plurality of fasteners, soldering, welding, or other suitable connection. As the stainless steel top is heated, the heat is conducted unevenly through and across the stainless steel top resulting in variations in thermal expansion; and with the top tightly secured at its edges, the stainless steel top often buckles or crowns upward at its center. Thus, the varying temperatures and resulting varying thermal expansions produce a convex-shaped top surface, which reduces an area of contact between the top surface and the vessel being heated and substantially reduces the efficiency of the heating process. Further, the crowned or convex shaped top surface is more susceptible to the vessel moving or walking over the top surface in the presence of a vibration. If the hot plate has a stirring capability, the tendency of the vessel to walk is greater.

Consequently, there is a need for a hot plate that has a chemically resistant, stainless steel top, which, when heated, experiences minimal buckling or crowning.

SUMMARY OF THE INVENTION

The present invention overcomes the foregoing and other shortcomings and drawbacks of stainless steel hot plates heretofore known for use in heating substances in industrial and laboratory processes. While the invention will be described in connection with certain embodiments, it will be understood that the invention is not limited to these embodiments. On the contrary, the invention includes all alternatives, modifications and equivalents as may be included within the spirit and scope of the present invention.

The present invention provides a hot plate with a stainless steel top plate that is resistant to corrosion and maintains an efficient heating cycle over a full range of operation of the hot plate. The stainless steel top hot plate of the present invention has a construction that minimizes buckling and crowning when heated and further, substantially reduces a tendency for a vessel being heated to move on the hot plate. Thus, the hot plate of the present invention provides an efficient heating cycle, a long service life and is especially useful in a laboratory environment.

In accordance with the principles of the present invention and in accordance with the described embodiments, the present invention provides a hotplate for heating a vessel containing a substance. The hotplate has a heating plate assembly with a stainless steel top plate to support the vessel. The stainless steel top plate has an upper surface with a substantially centrally located depression having a depth and area generally sufficient to absorb upward crowning of the stainless steel top plate when heated. A heating unit is in a heat transfer relation with the stainless steel top plate, and a base unit is connected to the heating plate assembly. However, the base unit is not fastened directly to the stainless steel top plate, so that the stainless steel top plate can expand more uniformly when heated.

In one aspect of the invention, the heating plate assembly also has compression plate and a fastener for securing the compression plate to the stainless steel top plate. The fastener is located near a center of the stainless steel top plate. The compression plate has a plurality of fasteners located near a compression plate periphery for connecting the compression plate to the base unit.

In another embodiment of the invention, the heating plate assembly has an insulator and a liquid-tight seal; and a threaded stud and nut secures the heating plate assembly together. The heating plate assembly may further include a blocking element that prevents a relative rotation between the stainless steel top plate and the compression plate.

In a further embodiment of the invention, the stainless steel top plate has an upper surface with a substantially centrally located concavity having a depth and area generally sufficient to minimize any crowning of the top plate when heated, An annular flange is substantially perpendicular to a lower surface of the stainless steel top plate and extends outward therefrom. A threaded stud has one end rigidly connected to a generally central location on the lower surface, and a pin is rigidly connected at a generally non-central location of the lower surface.

These and other objects and advantages of the present invention will become more readily apparent during the following detailed description together with the drawings herein.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
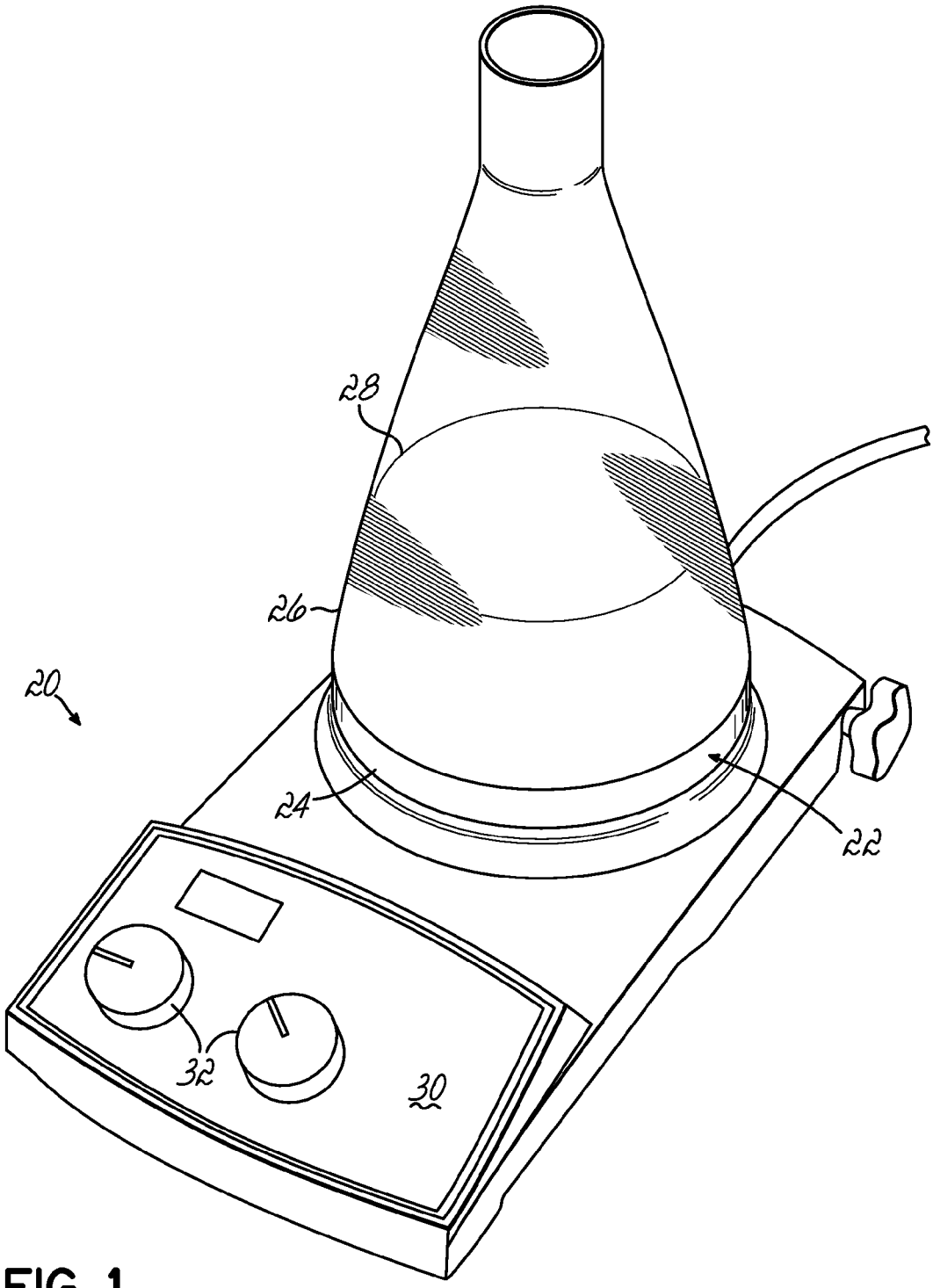
FIG. 1 is a perspective view of a hot plate having a heating unit with a stainless steel top plate in accordance with the principles of the present invention.

Referring to FIG. 1, a stirring hot plate 20 includes a heating plate assembly or unit 22 having a stainless steel top plate 24 for supporting a vessel 26 containing a substance 28 to be heated and/or stirred. The heating plate unit 22 is supported by a base unit 30, and often, the base unit 30 provides three points of support for the heating plate unit 22. The base unit 30 provides user operable I/O (input/output) devices 32 that, in a known manner, provide input data and commands to analog or digital controls (not shown) inside the base unit 30, which are operable to control an electric heating element. The base unit 30 may also, in a known manner, house a magnetic stirring device and associated user I/O devices, which are operable to provide a rotating magnetic field above the top plate unit 22, thereby rotating a magnetic stirring rod inside the vessel 26.

Figure 2:
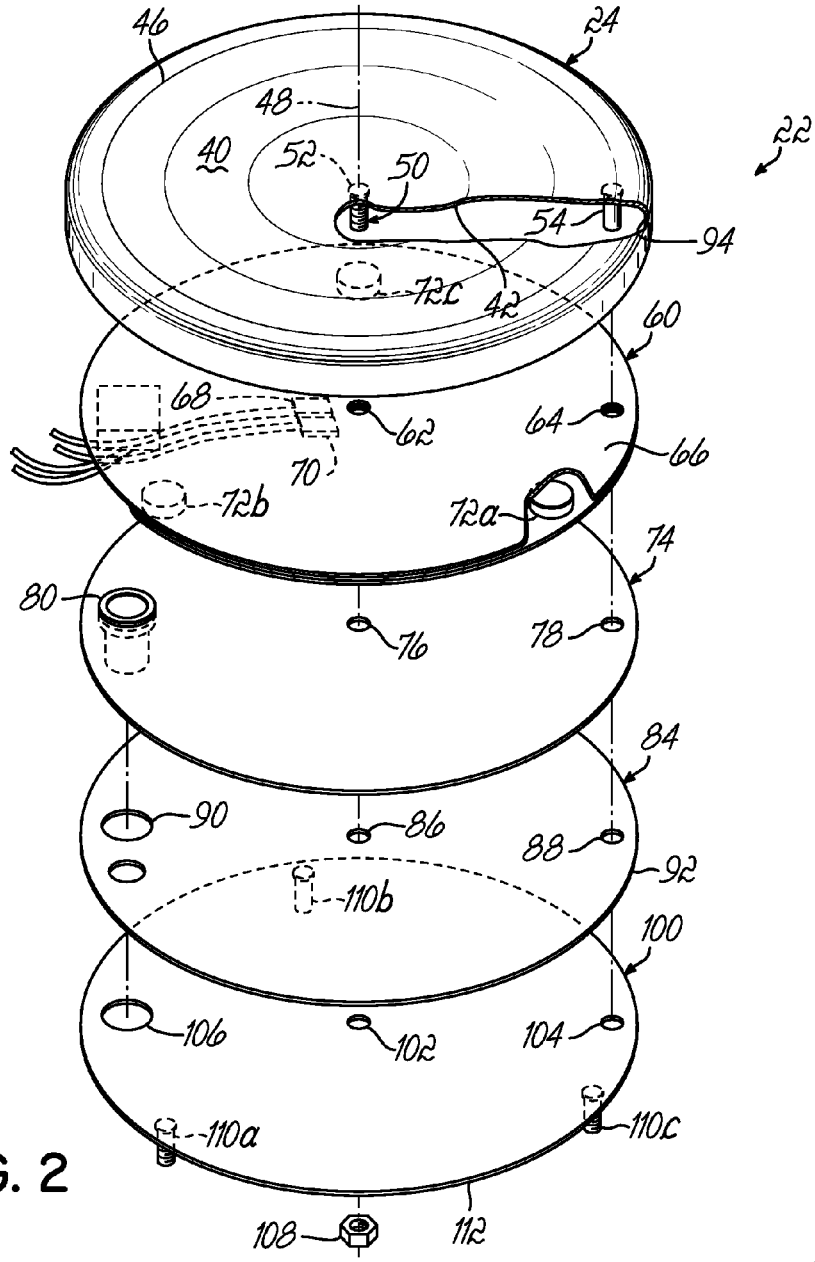
FIG. 2 is a disassembled perspective view of an exemplary embodiment of the stainless steel top unit of FIG. 1.
Figure 3:
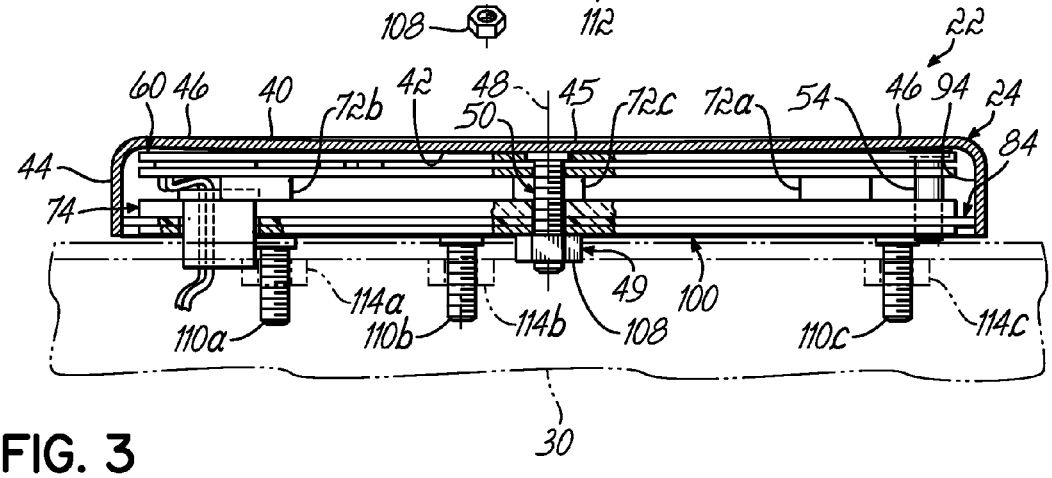
FIG. 3 is an assembled side view of the embodiment of the stainless steel top unit of FIG. 1.

Referring to FIG. 2, the top plate 24 of the heating top plate assembly 22 is made of a stainless steel material, for example, a 16 gauge sheet metal that is about 0.060 inch thick. The stainless steel top plate 24 has an upper surface 40, a lower surface 42 and an annular flange 44 that extends downward or outward from an outer periphery of the lower surface 42. The upper surface 40 is manufactured to have a depression 45 providing a generally concave cross-sectional profile. As shown in FIGS. 2 and 3, the concavity 45 extends over a substantial portion of the upper surface area 40 of the top plate 24 and begins to be discernable at 46, which is a generally circular line that is substantially closer to the outer peripheral flange 44 than a top plate centerline 48.

In this exemplary embodiment, a fastener 49 includes a threaded stud 50 and mating threaded nut 108. The threaded stud 50 has one end 52 connected to the stainless steel top plate bottom surface 42 at a location near the top plate centerline 48. A first structure 54, for example, a blocking element in the form of a pin, is also attached to the stainless steel top plate bottom surface 42 at a location radially displaced from the top plate centerline 48.

A heating unit 60 has holes 62, 64 that are located and sized to receive, respectively, the fastener 50 and pin 54. The heating unit 60 is positionable inside the flange 44 and beneath the stainless steel top plate 24 such that a heating element 66 is in a heat transfer relationship with the lower surface 42. The heating unit 60 further contains a control temperature sensor 68 and an over temperature sensor 70 that provide temperature feedback signals representative of the temperature of the heating element 66. A plurality of insulating spacers 72*a*, 72*b*, 72*c* have respective first ends in contact with a lower surface of the heating unit 60. An insulator 74 has holes 76, 78 that are located and sized to receive, respectively, the threaded stud 50 and pin 54. The insulator 74 is located within the flange 44 against opposite ends of the insulating spacers 72*a*, 72*b*, 72*c*. A tubular wire insulator 80 is located against a lower surface of the insulator 74 and provides a thermally protected conduit for electric wires connected to the heating element 66 and temperature sensors 68, 70.

A seal 84 has a first hole 86, a second hole 88 and a third hole 90 that are located and sized to receive, respectively, the threaded stud 50, the pin 54 and the wire insulator 80. The seal 84 is also positioned within the flange 44 and against the lower surface of the insulator 74. The seal 84 has an outer periphery 92 that is sized and shaped to have an interference fit with an inner surface 94 of the flange 44, and thus, the seal 84 provides a generally liquid tight seal with the flange 44 and prevents liquids spilled on the top plate assembly 22 from contacting the heating unit 60. The seal 84 is also often made from a mica material and provides an additional thermal barrier.

A compression plate 100 has a first hole 102, a second hole 104 and a third hole 106 that are located and sized to receive, respectively, the threaded stud 50, the pin 54 and the wire insulator 80. The compression plate 100 is positionable inside the flange 44 and against the second thermal barrier 84. The threaded nut 108 of the fastener 49 is engageable with the threaded stud 50 to secure the compression plate 100, the seal 84, the insulator 74, the heating unit 60 and the stainless steel top plate 24 into a unitary assembly of the heating plate unit 22 as shown in FIG. 3. When so assembled, the heating element 66 is in a heat transfer relationship with the lower surface 44; but the insulator 74 is maintained a desired distance from the heating unit 60 as represented by the spacers 72*a*-72*c*.

The angular alignment of those components in the assembly is provided by the locating pin 54 and second structure represented by the holes 64, 78, 88 and 104 in, respectively, the heating unit 60, insulator 74, seal 84 and compression plate 100. The pin 54 and holes 64, 78, 88 and 104 prevent any relative angular motion or rotation between the compression plate 100, the seal 84, the insulator 74, the heating unit 60 and the stainless steel top plate 24.

The compression plate 100 further has a plurality of threaded studs 110*a*, 110*b*, 110*c* that extend downward from a lower surface 112 and are used to connect the top plate assembly 22 to the base unit 30 by means of mating threaded nuts or receptacles 114*a*, 114*b*, 114*c* located in the base unit 30. Thus, there is no direct and single mechanical connection between the stainless steel top plate 24 and the base unit 30. In known hot plates, the periphery of the stainless steel top plate 24 is connected to the base unit 30 by fasteners, soldering, welding, or other suitable connection. With the stainless steel periphery rigidly connected to the base unit 30, when the stainless steel top plate is heated, it is quick to expand upward and crown at the center. With the heating plate assembly of FIG. 2, the periphery of the stainless steel top plate 24 is not connected to the base unit 30 and is better able to expand and move with the application of heat.

In use, a user first places a vessel on the stainless steel top plate 24. The concavity 45 helps locate the vessel generally concentrically with the centerline 48. The user then commands, via the I/O devices 32, the heating unit 60 to be energized to heat the stainless steel top plate and vessel 28.

Upon heat being applied to the stainless steel top plate 24, due to the relatively poor thermal conductivity of the stainless steel, the top plate often does not expand uniformly. Thus, there often is a tendency for the stainless steel top plate 24 to expand upward in a direction tending to create a crown or convex cross-sectional profile. However, the use of the threaded stud 50 and nut 108 to tightly connect the compression plate 100 and intervening layers to the stainless steel top plate 24 reinforces and presents a thicker mass about the centerline 48 to react the upward directed forces. Thus, using the center stud 50 to connect the assembly of layers at the centerline 48 limits or reduces the tendency of the stainless steel top plate 24 to deform or crown in an upward direction. Further, to the extent that the stainless steel top plate 24 expands upwardly, any initial expansion is absorbed by the amount of concavity 45. Thus, as the stainless steel top plate 24 is heated, even though the center stud 50 limits the upward expansion of the top plate 24, some expansion in an upward direction may occur. In that event, the concavity 45 is reduced and/or eliminated; and the cross-sectional profile of the stainless steel top plate 24 changes from a generally concave profile to a substantially flat profile. In the event that there is further upward expansion of the stainless steel hot plate, so that a small crown or convex cross-sectional profile occurs, the magnitude of any crowning is substantially less than crowning of stainless steel top plates without the center stud fastener 50 and the concavity 45. For all practical purposes, the use of the center fastener 50 and concavity 45 results in a stainless steel top plate that is substantially flat when heated.

The location and size of the concavity 45 may vary somewhat with the manufacturing process used to produce the concavity 45; and further, there may be variations in the depth and area of the concavity 45 from one top plate to another. Generally, the depth and area of the concavity 45 are chosen to absorb any crowning caused by heating the top plate 24 during use. in the exemplary embodiment shown in FIG. 2, the concavity 45 has a maximum displacement of at least about 0.20 inch as measured near the centerline 48 in a direction substantially perpendicular to the top plate 24.

The heating plate unit 22 described herein has several advantages. First, it provides a hot plate with a stainless steel top plate 24 that is resistant to corrosion and maintains an efficient heating cycle over a full range of operation of the hot plate 20. Second, the concavity 45 helps center a vessel upon initial placement on the stainless steel top plate 24. Further, in the presence of a vibration, the concavity 45 causes the vessel to move toward the center of the stainless steel top plate 24. Third, with the center stud 50 and concavity 45, the heating plate unit 22 has a construction that minimizes and often eliminates any crowning of the stainless steel top plate 24 when it is heated. Thus, the hot plate 20 has a stainless steel top plate 24 that is resistant to chemical corrosion, provides an efficient heating cycle, a long service life and is especially useful in a laboratory environment.

While the invention has been set forth by a description of the preferred embodiment in considerable detail, it is not intended to restrict or in any way limit the claims to such detail. Additional advantages and modifications will readily appear to those who are skilled in the art. For example, in the disclosed embodiment, a threaded stud 50 and nut 108 are shown in an exemplary embodiment for securing the components of the heating plate unit 22 near its centerline 48. In other embodiments, other forms of mechanical fasteners may be used, for example, one or more rivets or comparable fasteners; and in further embodiments, the components can be adhered, bonding, glued or otherwise connected together at the centerline 48. In still further embodiments, some form of welding may be used.

Further, in the exemplary embodiment, a pin 54 and holes 64, 78, 88 and 104 are used as first and second structure, respectively, to maintain the components of the heating plate unit 22 in angular alignment and stationary. In other embodiments, other structure may be used such as a projection, embossment or key on the inner surface 94 of the flange 44 and mating notches in the respective edges of the heating unit 60, insulator 74, seal 84 and compression plate 100. In a further embodiment, the pin 54 may be a threaded stud that may, or may not, utilize a mating nut.

In addition, in the exemplary embodiments shown and described with respect to FIGS. 1-3, the heating plate assembly 22 is described as being applied to a hot plate. However, in other embodiments, the heating plate assembly 22 of FIGS. 2 and 3 can alternatively be applied to a stirring hot plate.

Therefore, the invention in its broadest aspects is not limited to the specific detail shown and described. Consequently, departures may be made from the details described herein without departing from the spirit and scope of the claims which follow.

What is claimed is:

1. An electric heating apparatus for heating a vessel containing a substance, the electric heating apparatus comprising:

a heating plate assembly comprising a stainless steel top plate having an upper surface adapted to support the vessel, the upper surface comprising a substantially centrally located depression having a depth and area generally sufficient to absorb upward crowning of the top plate when heated;

a heating unit comprising electrical heating element in a heat transfer relation with the stainless steel top plate; and a base unit connected to the heating plate assembly, the base unit not being fastened directly to the stainless steel top plate, thereby permitting a generally uniform expansion of the stainless steel top plate when heated.

2. The electric heating apparatus of claim 1 further comprising:

a fastener connected to a lower surface of the stainless steel top plate at a location near a center of the stainless steel top plate; and a compression plate comprising a plurality of fasteners located near a periphery of the compression plate and connected to the base unit, the base unit not being connected directly to the stainless steel top plate by the plurality of fasteners and thus, the stainless steel top plate experiences a generally uniform expansion when heated.

3. The electric heating apparatus of claim 1 wherein the depression has a depth of at least about 0.020 inch.

4. The electric heating apparatus of claim 2 wherein the fastener comprises a threaded stud and mating threaded nut.

5. The electric heating apparatus of claim 2 further comprising:

a first structure on the stainless steel top plate; and a second structure on the compression plate, the second structure cooperating with the first structure to prevent a rotation of the stainless steel top plate with respect to the compression plate.

6. The electric heating apparatus of claim 5 wherein in the first structure is a pin extending from the lower surface and the second structure is a hole in the compression plate.

7. The electric heating apparatus of claim 5 wherein in the first structure is a pin extending from the lower surface and the second structure is a hole in the compression plate.

8. The electric heating apparatus of claim 2 further comprising:

an insulator adjacent the heating unit, the insulator comprising a hole receiving the fastener; and a seal between the insulator and the compression plate and providing a substantially liquid-tight seal between the compression plate and the heating unit, the seal comprising a hole receiving the fastener.

9. The electric heating apparatus of claim 8 wherein the seal provides a thermal barrier.

10. The electric heating apparatus of claim 8 further comprising spacers separating the heating unit from the insulator.

11. The electric heating apparatus of claim 1 wherein in the heating unit further comprises a first temperature sensor providing a feedback signal representing a current temperature of the stainless steel top plate.

12. An electric heating apparatus for heating a vessel containing a substance, the apparatus comprising:

a heating plate assembly comprising a stainless steel top plate comprising a generally horizontal upper surface adapted to support the vessel, the upper surface comprising a concave cross-sectional profile starting near an outer periphery of the upper surface and increasing substantially uniformly inward to a center of the stainless steel top plate, and a lower surface, a fastener comprising one end rigidly connected to the lower surface of the stainless steel top plate at a location near the center of the stainless steel top plate, a heating unit comprising electrical heating element in a heat transfer relation to the lower surface of the stainless steel top plate, the heating unit comprising a hole receiving the fastener, an insulator adjacent the heating unit, the insulator comprising a hole receiving the fastener, a compression plate adjacent the insulator, the compression plate being connectable with the fastener to secure an assembly of the stainless steel top plate, the heating unit, the insulator and the compression plate, and the compression plate comprising a plurality of fasteners located near a periphery of the compression plate; and a base unit connected by the plurality of fasteners to the compression plate, the base unit not being fastened directly to the stainless steel top plate by the plurality of fasteners and thus, the stainless steel top experiences minimal buckling and crowning when heated.

13. A heating plate apparatus for attachment to a base of an electric heating apparatus for heating a vessel containing a substance, the top plate apparatus comprising:

a stainless steel top plate comprising a generally horizontal upper surface adapted to support the vessel, the upper surface having a substantially centrally located concavity with a depth and area generally sufficient to absorb upward crowning of the top plate when heated, an opposed lower surface, and an annular flange generally perpendicular to the lower surface and extending away from an outer periphery of the lower surface;

a fastener having one end rigidly connected to the lower surface at a location near a center of the lower surface;

a heating unit positioned inside the flange and in a heat transfer relation to the lower surface of the stainless steel top plate, the heating unit having a hole receiving the fastener and at least one temperature sensor providing a feedback signal representing a temperature of the stainless steel top plate;

an insulator positioned inside the flange and comprising a hole receiving the fastener; and a compression plate positioned inside the flange and contacting the insulator, the fastener contacting the compression plate and securing an assembly of the stainless steel top plate, the heating unit, the insulator and the compression plate inside the flange, and the compression plate comprising a plurality of fasteners located near a periphery of the compression plate and adapted to be connect the compression plate to a base unit, the base unit not being connectable directly to the stainless steel top plate by the plurality of fasteners, thereby permitting a generally uniform expansion of the stainless steel top plate when heated.

14. The heating plate apparatus of claim 13 further comprising a seal between the insulator and the compression plate and providing a generally liquid-tight seal between the compression plate and the heating unit, the seal comprising a hole receiving the fastener.

15. The heating plate apparatus of claim 14 wherein the seal provides a thermal barrier.

16. The heating plate apparatus of claim 14 further comprising a plurality of insulating spacers separating the heating unit from the insulator.

17. The heating plate apparatus of claim 13 wherein the fastener comprises a threaded stud and mating threaded nut.

18. The heating plate apparatus of claim 13 further comprising a blocking element rigidly connected at a generally noncentral location of the stainless steel top plate, the blocking element blocking a rotation of stainless steel top plate with respect to the compression plate.

19. The heating plate apparatus of claim 13 further comprising a first structure on the stainless steel top plate; and a second structure on the compression plate, the second structure cooperating with the first structure to prevent a rotation of the stainless steel top plate with respect to the compression plate.

20. An apparatus for use with an electric heating apparatus for heating a vessel containing a substance, the apparatus comprising:

a stainless steel top plate comprising an upper surface adapted to support the vessel, the upper surface comprising a substantially centrally located concavity having a depth and area generally sufficient to minimize any crowning of the top plate when heated, a lower surface, and a annular flange substantially perpendicular to the lower surface and extending outward from an outer periphery of the lower surface;

a threaded stud having one end rigidly connected to a generally central location of the lower surface; and a pin rigidly connected at a generally noncentral location of the lower surface.

* * * * *

UNITED STATES PATENT AND TRADEMARK OFFICE

CERTIFICATE OF CORRECTION

PATENT NO. : 7,326,885 B2
APPLICATION NO. : 11/381228
DATED : February 5, 2008
INVENTOR(S) : Mark D. Lockwood It is certified that error appears in the above-identified patent and that said Letters Patent is hereby corrected as shown below:

In column 1, line 6, change “and more particularly,” to --and, more particularly,--.

In column 1, line 43, change “for example, copper iron, glass,” to --for example, copper, iron, glass,--.

In column 2, line 25, change “and further, substantially reduces” to --and further substantially reduces--.

In column 2, line 62, change “when heated, An” to --when heated. An--.

In column 3, line 29, change “and often, the base unit” to --and often the base unit--.

In column 4, line 19, change “and thus, the seal” to --and thus the seal--.

In column 5, line 37, change “during use. in the exemplary embodiment” to --during use. In the exemplary embodiment--.

In column 6, line 1, change “be adhered, bonding, glued” to --be adhered, bonded, glued--.

In claim 13, column 8, line 18, change “adapted to be connect the compression plate” to --adapted to connect the compression plate--.

Signed and Sealed this

Fifteenth Day of July, 2008

JON W. DUDAS
*Director of the United States Patent and Trademark Office*